United States Patent [19]

Rossmann et al.

[11] Patent Number: 4,536,127

[45] Date of Patent: Aug. 20, 1985

[54] TURBOCOMPRESSOR PROVIDED WITH AN ABRADABLE COATING

[75] Inventors: Axel Rossmann, Karlsfeld; Herbert Merz, Munich, both of Fed. Rep. of Germany

[73] Assignee: Motoren-Und Turbinen-Union, Munich, Fed. Rep. of Germany

[21] Appl. No.: 605,773

[22] Filed: May 1, 1984

[30] Foreign Application Priority Data

May 6, 1983 [DE] Fed. Rep. of Germany ..... 3316535

[51] Int. Cl.[3] ..... F16J 15/16

[52] U.S. Cl. ..... 415/174; 415/170 R; 415/196; 415/197; 416/174; 277/96; 277/96.2

[58] Field of Search ..... 415/174, 170 R, 196, 415/197, 200, 172 A, 9; 416/174; 277/53, DIG. 6, 96, 96.2, 96.1; 428/614, 408

[56] References Cited

U.S. PATENT DOCUMENTS

| | | | |
|---|---|---|---|
| 2,905,093 | 9/1959 | Raub et al. | 415/200 |
| 3,053,694 | 9/1962 | Daunt et al. | 415/174 |
| 3,092,306 | 6/1963 | Eder | 277/53 |
| 3,547,455 | 12/1970 | Daunt | 415/197 |
| 3,625,634 | 12/1971 | Stedfeld | 415/174 |
| 4,149,824 | 4/1979 | Adamson | 415/9 |
| 4,460,185 | 7/1984 | Grandy | 415/174 |

*Primary Examiner*—Robert E. Garrett
*Assistant Examiner*—John Kwon
*Attorney, Agent, or Firm*—Roberts, Spiecens & Cohen.

[57] ABSTRACT

An improvement for a turbocompressor having a rotor, a stator and a casing, and an abradable coating provided between the rotor blades and the casing, or between the stator vanes and the rotor, such that the blades make initial contact with the coating to abrade the coating and produce a minimal clearance. The abradable coating is formed on a member having a first layer of carbon-fiber reinforced graphite adapted for attaching the coating member to the casing or rotor, and a second layer of graphite in the region in which the blade tips are intended to rub. The second layer may optionally contain, preferably radially oriented brush-type graphite-fiber reinforcements, or be entirely composed thereof.

16 Claims, 1 Drawing Figure

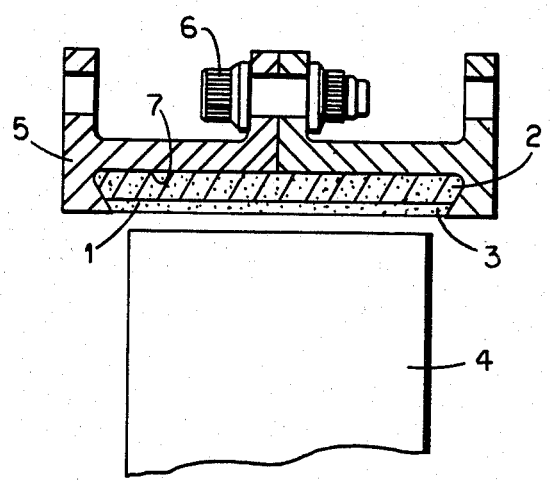
6
7
5
2
1
3
4

TURBOCOMPRESSOR PROVIDED WITH AN ABRADABLE COATING

FIELD OF THE INVENTION

This invention relates to a turbocompressor having a rotor, stator and casing, and a member with an abradable coating provided between the rotor blades and the casing, or between the stator vanes and the rotor. The blades come into initial contact with the abradable coating to abrade the coating to produce a minimal clearance therewith.

PRIOR ART

The tip clearance between the rotor blades and the casing, or between the stator vanes and the rotor, is a factor in respect of the efficiency and performance of a turbocompressor. The clearance should be a minimum. This is normally achieved by the use of an abradable coating against which the blades make initial contact to produce a minimal clearance. For the purpose, the coatings must meet certain conditions.

Firstly, the blade tips should not be subjected to excessive abrasion.

Secondly, the blades should generally not overheat when being run in and when the blades are made from titanium, they should not be allowed to start a titanium fire.

Thirdly, the material of the layer below the blade should not be overstressed by induced vibration.

Fourthly, in order to prevent material smearing, any build-up of material on both the rubbing surface of the coating and on the blade tips should be prevented.

Fifthly, abrasion debris should not cause erosion or unacceptable coatings in downstream stages.

Sixthly, the hot components of a turbine-compressor spool, especially the combustion chamber and the turbine blades, should not be impaired, i.e., abrasive material from the coating should not react with the base material or block cooling air holes.

Seventhly, toxic abrasive material must, by all means, be prevented, for it could mix with the cabin bleed air.

Eighthly, the coatings must satisfy erosion and corrosion resistance requirements, and they should sufficiently resist oxidation and heat.

Ninthly, abradable coatings should also permit easy removal when an assembly comes in for overhaul and/or repair.

State-of-the-art abradable coatings for high-temperature applications (to about 450° C.) are constituted by sprayed nickel-graphite coatings. These coatings have insufficient resistance to erosion and corrosion in the rear (hot) compressor stages. Additionally, abrasive matter from these coatings block the cooling air holes of the hot components and accordingly may cause comprehensive consequential damage by overheating. Also, the nickel oxide generated in the process is toxic.

SUMMARY OF THE INVENTION

An object of the present invention is to provide a turbocompressor in which an abradable coating is provided which avoids the aforesaid disadvantages and, more particularly, which ensures, in simple manner, that damage in the abrading process is substantially prevented.

It is a particular object of the present invention to provide an abradable coating member consisting of a first layer of carbon-fiber reinforced graphite in the region in which the coating member is attached to the casing or rotor and a second layer of graphite in the region for rubbing contact with the blade tips.

According to a particular aspect of the present invention, the first and second graphite layers are integrally joined to one another or they are homogenously formed.

In a preferred mode of the present invention, the abradable coating member is of segmented or annular shape.

For best results, the second graphite layer comprises a brush-type graphite-fiber reinforcement with radially oriented fibers, or else it is replaced by such a brush type, fiber reinforcement.

The thickness of the second graphite fiber layer is preferably about 1 mm.

For purposes of attaching the abradable coating member to the support, the first graphite layer is seated by interlocking arrangement in an annular metal support fixedly connected to the casing, the interlocking engagement being attained by seating the abradable coating member in dovetail fashion in the metal support.

Alternatively, the first graphite layer can be attached to the annular metal support (which is fixedly connected to the casing) by bonding, especially by bonding with an adhesive.

The present invention accordingly provides an abradable coating member for a turbocompressor which in the rubbing zone is free from fiber reinforcement, which could adversely affect the abrading process, by providing a second layer of nonreinforced graphite in this zone. The second graphite layer may optionally have or be entirely composed of a preferably radially oriented, brush-type graphite fiber reinforcement that will not adversely affect the abrading process. In such case, the second graphite layer may be homogeneously formed with the first layer so that the first layer in the attachment zone of the coating will be radially-oriented, brush-type graphite fiber reinforcements together with the carbon fiber reinforcements.

The abradable coating member of the present invention affords sufficient mechanical strength. Also, the abrasive material will advantageously burn off without producing contaminants or toxicants. Nor does it threaten to block hot parts of the compressor assembly, and no intolerable reactions will occur with the hot parts. For titanium blades, this will protect against titanium fire. The abradable coating provides an altogether agreeable response to rubbing, and no material will build up in the blade tip clearance to produce smearing. Thermal expansion will be modest (or practically nonexistent). This enables the clearance to be maintained very well in the presence of temperature variations. The abradable coating is easily machined and has a moderate weight. A further advantage is afforded by the consistently good quality of a single abradable coating along the circumference and of all of the abradable coatings of the turbocompressor assembly. A special advantage is provided in that in overhaul or repair work on a turbocompressor, abradable coating members attached by bonding or an interlocking arrangement can simply be removed.

The invention is described more fully in light of the accompanying drawing of an embodiment.

BRIEF DESCRIPTION OF THE DRAWING

The sole FIGURE of the drawing is a schematic cross-sectional illustration of the blade tip area of a turbocompressor according to the present invention.

DETAILED DESCRIPTION OF THE PREFERRED EMBODIMENT

In the drawing is seen the tip region 4 of a turbocompressor blade and an abradable coating member 1 opposed to and facing the blade tip. The abradable coating member 1 is seated in a recess 7 in dovetail fashion in interlocking arrangement in a metal support 5 fixedly connected to the casing (not shown) of the turbocompressor. The metal support 5 is in the form of a ring consisting of two halves bolted together by bolts 6 or other suitable releasable attachment means. The bolted connection permits the abradable coating member 1 to be locked in the metal support 5 at the time of assembly. Similarly, the bolted connection can be unscrewed to remove the abradable coating member.

The abradable coating member 1 consists of a first layer 2 of carbon-fiber reinforced graphite and a second layer 3 comprised solely of non-reinforced graphite. The first graphite layer 2 is arranged in the region of attachment to the casing, while the second graphite layer 3 is arranged to be in rubbing contact with the blade tips 4. The graphite layers 2,3 are integrally joined together or homogeneously formed. The member 1 can be composed of part-annular segments or of an annular ring. For the proper minimal clearance between the blade tips 4 and the adjacent abradable coating, a thickness of 1 mm. for the second layer 3 will be sufficient. During the abrading process, only the second graphite layer 3 will be partially removed by abrasive action. Destruction of the concealed first graphite layer 2 is prevented. This makes it reliably certain that the abradable coating member as a whole has sufficient mechanical strength and that abrasive matter from the second graphite layer will not cause consequential damage.

In the illustrated embodiment the interlocking arrangement is employed to seat and retain the abradable coating member 1 in the metal support 5. The coating assembly can optionally be attached to the metal support by a bonding process, such as with an adhesive. In that case, the bonded coating member can be removed by burning, if necessary, for overhaul purposes.

Although the invention has been disclosed in conjunction with a single embodiment thereof, it will become apparent to those skilled in the art that numerous modifications and variations can be made within the scope and spirit of the invention as defined in the attached claims.

What is claimed is:

1. In a turbocompressor having a rotatable element comprising a rotor including rotor blades, a stationary element comprising a stator including stator vanes and a casing, and a member with an abradable coating interposed between the rotatable and stationary elements, said abradable coating facing the rotor blades such that the rotor blades come into initial contact with the coating to produce a minimal clearance therewith, the improvement wherein said member with the abradable coating comprises a first layer of carbon-reinforced graphite and a second layer comprised solely of graphite, said first layer being supported by one of said elements with said second layer facing the other of said elements to be abraded upon relative rotation of said elements to establish the minimal clearance therebetween.

2. The improvement as claimed in claim 1 wherein said first and second layers are integrally joined to one another.

3. The improvement as claimed in claim 1 wherein said first and second layers are homogeneously formed of said graphite with the carbon reinforcement disposed solely in said first layer.

4. The improvement as claimed in claim 1 wherein said member with the abradable coating is of ring shape.

5. The improvement as claimed in claim 1 wherein said member comprises a plurality of part annular segments.

6. The improvement as claimed in claim 1 wherein said second layer includes a brush-type graphite fiber reinforcement with radially oriented fibers.

7. The improvement as claimed in claim 1 wherein said second layer has a thickness of approximately 1 mm.

8. The improvement as claimed in claim 1 wherein said one element includes a support fixed to said one element and further comprising means securing said member to said one element with said second layer facing said other element.

9. The improvement as claimed in claim 8 wherein said support comprises an annular metal member.

10. The improvement as claimed in claim 9 wherein said means which secures said member to said one element comprises a bonded connection.

11. The improvement as claimed in claim 10 wherein said bonded connection includes adhesive means.

12. The improvement as claimed in claim 9 wherein said means which secures said member to said one element comprises an interlocking connection.

13. The improvement as claimed in claim 12 wherein said interlocking connection is separable to release said member.

14. The improvement as claimed in claim 13 wherein said interlocking connection includes a dovetail engagement between said member and said one element which prevents removal of said member from said one element, said one element including a pair of separate elements cooperatively defining a dovetail shaped recess for said member, and releasable attachment means joining said pair of separate elements together.

15. The improvement as claimed in claim 1 wherein said member is secured to said stationary element with said second layer facing the rotor blades and said first layer remote from the rotor blades.

16. The improvement as claimed in claim 1 wherein said second layer consists of brush-type graphite fibers oriented in radial direction.

* * * * *